US010829875B2

(12) United States Patent
Achtymichuk et al.

(10) Patent No.: US 10,829,875 B2
(45) Date of Patent: Nov. 10, 2020

(54) KNIT SLEEVE PATTERN

(71) Applicant: NIKE, Inc., Beaverton, OR (US)

(72) Inventors: Arnie J. Achtymichuk, Portland, OR (US); Andrea J. Staub, Portland, OR (US)

(73) Assignee: NIKE, INC., Beaverton, OR (US)

( * ) Notice: Subject to any disclaimer, the term of this patent is extended or adjusted under 35 U.S.C. 154(b) by 263 days.

(21) Appl. No.: 15/608,677

(22) Filed: May 30, 2017

(65) Prior Publication Data

US 2017/0342610 A1 Nov. 30, 2017

Related U.S. Application Data

(60) Provisional application No. 62/343,561, filed on May 31, 2016.

(51) Int. Cl.

| | |
|---|---|
| ***D04B 1/24*** | (2006.01) |
| ***A41D 27/10*** | (2006.01) |
| ***A41D 31/14*** | (2019.01) |
| ***D04B 1/10*** | (2006.01) |
| ***D04B 1/22*** | (2006.01) |
| ***A41D 27/28*** | (2006.01) |

(52) U.S. Cl.

CPC ..... *D04B 1/24* (2013.01); *A41D 27/10* (2013.01); *A41D 27/28* (2013.01); *A41D 31/14* (2019.02); *D04B 1/10* (2013.01); *D04B 1/22* (2013.01); *D04B 1/246* (2013.01)

(58) Field of Classification Search

CPC ... D04B 1/24; D04B 1/10; D04B 1/12; D04B 1/22; D04B 1/246

See application file for complete search history.

(56) References Cited

U.S. PATENT DOCUMENTS

| | | | |
|---|---|---|---|
| 404,551 | A | 6/1889 | North |
| 601,489 | A | 3/1898 | Louis |
| 1,169,256 | A | 1/1916 | Grimm et al. |
| 1,350,169 | A | 8/1920 | Mullane |
| 1,703,808 | A | 2/1929 | Wright |

(Continued)

FOREIGN PATENT DOCUMENTS

| | | | |
|---|---|---|---|
| CN | 1630749 | A | 6/2005 |
| CN | 2711199 | Y | 7/2005 |

(Continued)

OTHER PUBLICATIONS

"Cobraw Compression Shirt With Thumb-Hole Long Sleeve—Grey," Cobraw, cobraw.com http://cobraw.com/products/cobraw-compression-shirt-with-thumb-hole-long-sleevegrey-fauna-rangel; 3 pages.

(Continued)

*Primary Examiner* — Danny Worrell

(74) *Attorney, Agent, or Firm* — Shook, Hardy and Bacon L.L.P.

(57) ABSTRACT

Present aspects are directed a knit sleeve pattern having various pattern portions corresponding to different areas of a wearer's arm, such as a shoulder portion, a neckline extension, an elbow portion, a forearm portion, and a wrist portion. In further aspects, the underarm extension may displace a traditional underarm seam to a location below the upper arm portion, thereby including a front and back body extension.

16 Claims, 12 Drawing Sheets

(56) References Cited

U.S. PATENT DOCUMENTS

| | | | | |
|---|---|---|---|---|
| 1,863,719 | A | 6/1932 | Lawson et al. | |
| 1,973,419 | A | 9/1934 | Trageser | |
| 1,979,233 | A | 10/1934 | Smith, Jr. | |
| 2,291,025 | A | 7/1942 | Casella | |
| 2,309,037 | A | 1/1943 | Berman | |
| 2,314,226 | A | 3/1943 | Lee | |
| 2,364,066 | A | 12/1944 | Giuseffi | |
| 2,394,541 | A | 2/1946 | Freedman | |
| 2,399,428 | A | 4/1946 | Daniels | |
| 2,426,819 | A | 9/1947 | Clyne | |
| 2,434,809 | A | 1/1948 | Northrup | |
| 2,438,171 | A | 3/1948 | Jamieson | |
| 2,456,190 | A * | 12/1948 | Heilbronner | A41D 1/04 2/113 |
| 2,466,887 | A | 4/1949 | Berger | |
| 2,554,380 | A | 5/1951 | Olrich et al. | |
| 2,575,700 | A | 11/1951 | Artzt | |
| 2,610,496 | A | 9/1952 | Kostopoulos | |
| 2,613,360 | A * | 10/1952 | Friedland | A41D 13/0015 2/113 |
| 2,739,467 | A | 3/1956 | Stern | |
| 2,836,826 | A | 6/1958 | Geiss | |
| 2,839,756 | A | 6/1958 | Geiss | |
| 2,848,719 | A | 8/1958 | Clyne | |
| 2,986,740 | A * | 6/1961 | Schudson | A41D 27/10 2/115 |
| 3,037,210 | A | 6/1962 | Neuman | |
| 3,078,699 | A * | 2/1963 | Huntley | A41D 1/04 2/115 |
| 3,719,956 | A | 3/1973 | Glassberg | |
| 3,796,068 | A * | 3/1974 | Betts | A41D 27/10 66/176 |
| 3,801,987 | A | 4/1974 | Thompson | |
| 4,356,570 | A * | 11/1982 | Vernon | A41D 13/08 2/126 |
| D304,258 | S | 10/1989 | Mitchell et al. | |
| 4,937,883 | A | 7/1990 | Shirai | |
| 4,967,419 | A * | 11/1990 | Elliott | A41D 13/08 2/16 |
| 4,985,934 | A * | 1/1991 | Perry | A41D 13/08 2/125 |
| 5,165,110 | A | 11/1992 | Grilliot et al. | |
| 5,349,704 | A * | 9/1994 | Masters | A41D 13/0015 2/113 |
| 5,357,633 | A * | 10/1994 | Rael | A41D 13/08 2/126 |
| 5,431,030 | A | 7/1995 | Ishizaki et al. | |
| 5,608,913 | A | 3/1997 | Lacoste | |
| 5,638,546 | A * | 6/1997 | Vita | A41D 13/08 2/16 |
| 5,737,773 | A | 4/1998 | Dicker et al. | |
| 5,746,068 | A | 5/1998 | Popa et al. | |
| D398,720 | S * | 9/1998 | Lesher, Jr. | D29/120.1 |
| 5,937,442 | A | 8/1999 | Yamaguchi et al. | |
| 6,047,406 | A | 4/2000 | Dicker et al. | |
| 6,202,216 | B1 | 3/2001 | Watanabe | |
| 6,223,565 | B1 * | 5/2001 | Cooper | A41D 13/08 66/172 E |
| 6,287,169 | B1 | 9/2001 | Willms et al. | |
| 6,353,934 | B1 | 3/2002 | Tada et al. | |
| 6,546,564 | B1 | 4/2003 | Palmer | |
| 6,766,666 | B2 * | 7/2004 | Okamoto | D04B 1/24 66/176 |
| 6,889,530 | B2 * | 5/2005 | Urano | A41B 9/06 66/176 |
| 6,892,396 | B2 | 5/2005 | Uno et al. | |
| 6,981,955 | B2 * | 1/2006 | Schultze | A61F 13/041 602/3 |
| 7,260,961 | B1 | 8/2007 | Kennedy | |
| 7,395,557 | B1 | 7/2008 | Ledyard | |
| 7,636,950 | B2 * | 12/2009 | Melhart | A41D 13/0015 2/69 |
| D622,938 | S | 9/2010 | Kanada et al. | |
| 7,856,668 | B2 | 12/2010 | Demarest et al. | |
| 7,905,117 | B2 | 3/2011 | Kronback | |
| 7,937,771 | B2 | 5/2011 | Mazzarolo | |
| 8,172,782 | B2 | 5/2012 | Rock | |
| 8,256,027 | B2 | 9/2012 | Pedersen et al. | |
| D691,782 | S | 10/2013 | Meredith | |
| 8,904,563 | B2 | 12/2014 | Lambertz | |
| 9,532,612 | B2 | 1/2017 | Lambertz | |
| 10,188,156 | B2 * | 1/2019 | Lubets | A41D 13/0015 |
| 2002/0168488 | A1 | 11/2002 | Gladfelter et al. | |
| 2003/0060845 | A1 | 3/2003 | Gardon-Mollard | |
| 2005/0015865 | A1 | 1/2005 | Chaix et al. | |
| 2005/0115282 | A1 | 6/2005 | Starbuck | |
| 2006/0042327 | A1 * | 3/2006 | Hummel | A41D 13/08 66/202 |
| 2006/0048263 | A1 | 3/2006 | Walsh | |
| 2007/0028351 | A1 | 2/2007 | Coolik | |
| 2007/0271671 | A1 | 11/2007 | Okajima | |
| 2010/0184355 | A1 | 7/2010 | Kennedy | |
| 2011/0126341 | A1 | 6/2011 | Soriano | |
| 2011/0302686 | A1 | 12/2011 | Chapuis | |
| 2013/0254971 | A1 | 10/2013 | Galluzzo et al. | |
| 2013/0312154 | A1 | 11/2013 | Koga et al. | |

FOREIGN PATENT DOCUMENTS

| | | | |
|---|---|---|---|
| CN | 201533587 | U | 7/2010 |
| CN | 201742972 | U | 2/2011 |
| CN | 201919660 | U | 8/2011 |
| DE | 3315400 | A1 | 10/1984 |
| EP | 1482080 | A1 | 12/2004 |
| FR | 2391663 | A1 | 12/1978 |
| FR | 2677855 | A1 | 12/1992 |
| FR | 2857830 | A1 | 1/2005 |
| GB | 190909617 | A | 4/1910 |
| GB | 516516 | A | 1/1940 |
| GB | 820869 | | 9/1959 |
| JP | 2007162162 | A | 6/2007 |
| WO | 03103423 | A1 | 12/2003 |
| WO | 2007031610 | A1 | 3/2007 |
| WO | 2012049687 | A1 | 4/2012 |
| WO | 2013159017 | A1 | 10/2013 |

OTHER PUBLICATIONS

Wilson, Jenna, "Thinking Beyond the Pattern," Knitty™, knitty.com, http://knitty.com/ISSUEfal104/FEATfall04TBP.htm; 5 pages.

TECHknitting, techknitting.blogspot.com, May 9, 2011; http://techknitting.blogspot.com/2011/05/my-sweater-is-too-tight-under-arms-or.html; 10 pages.

Larson, Lesli, "New: Archival Rugby Shirt," Archival: Made in USA, archivalclothing.com, Oct. 14, 2011. http://archivalclothing.com/new-archival-rugby-shirt/; 3 pages.

"Nike Pro Elite Knit," Innovation in Textiles, innovationintextiles.com, Aug. 19, 2013, Beaverton, OR. http://www.innovationintextiles.com/nike-pro-elite-knit-seamless-breathableand-lightweight/; 5 pages.

"Women's—Sauna Shirt," Kutting Weight, kuttingweight.com; http://kuttingweight.com/products/womens-kutting-weight-cutting-weight-neopreneweight-loss-sauna-shirt/?; 9 pages.

"Men's Short Sleeve Running Top—Black," TribeSports, shop.tribesports.com; https://shop.tribesports.com/men-short-sleeve-running-top-black; 32 pages.

"Jump High Jacket*Brushed—Final Sale," Ivivva, ivivva.com; http://www.ivivva.com/products/clothes-accessories/new/jumphigh-jacketbrushed?; cc=151968,skuId=ca_35627598,catId=new&crtt.pid=camp_wqPWrUmziSkG; 2 pages.

Pestes, Richard, "Castelli Flanders LS Base," PEZ Cycling News, pezcyclingnews.com, Dec. 12, 2013. http://www.pezcyclingnews.com/latestnews/castelli-winterkit/#.VSQSBvnF8tF; 12 pages.

"DKNYC Long-Sleeve Mixed-Media Sweatshirt," Polyvore, polyvore.com; http://www.polyvore.com/dknyc_long-sleeve_mixed-media_sweatshirt/thing?id=130629185; 4 pages.

"Brown Leather Jacket," Pinterest, pinterest.com; https://www.pinterest.com/pin/278801033153697131/: 3 pages.

(56) References Cited

OTHER PUBLICATIONS

Pappas, Alexandra, 11Knit Sweater, Pinterest, pinterest.com; https://www.pinterest.com/pin/467600373782036820/; 3 pages.

International Search Report and Written Opinion dated Jul. 18, 2017 in International Patent Application No. PCT/US2017/035165, 14 pages.

International Preliminary Report on Patentability dated Dec. 13, 2018 in International Patent Application No. PCT/US2017/035164, 8 pages.

International Preliminary Report on Patentability dated Dec. 13, 2018 in International Patent Application No. PCT/US2017/035165, 8 pages.

International Preliminary Report on Patentability dated Dec. 13, 2018 in International Patent Application No. PCT/US2017/035166, 8 pages.

International Search Report and Written Opinion dated Jul. 19, 2017 in International Patent Application No. PCT/US2017/035164, 13 pages.

International Search Report and Written Opinion dated Jul. 27, 2017 in International Patent Application No. PCT/US2017/035166, 14 pages.

Non-Final Office Action dated Jun. 13, 2019 in U.S. Appl. No. 15/608,686, 7 pages.

Non-Final Office Action dated Jun. 27, 2019 in U.S. Appl. No. 15/608,697, 9 pages.

Notice of Allowance dated Sep. 30, 2019 in U.S. Appl. No. 15/608,686, 5 pages.

Examination report dated Oct. 21, 2019 in Canadian Patent Application No. 3,025,809, 6 pages.

Communication pursuant to Article 94(3) dated Dec. 3, 2019 in European Patent Application No. 17729312.3, 5 pages.

Communication under Rule 71(3) dated Dec. 16, 2019 in European Patent Appliation No. 17729670.4, 35 pages.

Notice of Allowance received for U.S Appl. No. 15/608,697, dated Feb. 12, 2020, 5 pages.

Intention to Grant received for European Patent Application No. 17729313.1, dated May 4, 2020, 8 pages.

Office Action received for European Patent Application No. 17729312.3, dated May 28, 2020, 4 pages.

* cited by examiner

KNIT SLEEVE PATTERN

CROSS-REFERENCE TO RELATED APPLICATIONS

This application having attorney docket number NIKE.273935/150075US02 and entitled "Knit Sleeve Pattern," is a Non-Provisional Application claiming priority to U.S. Prov. App. No. 62/343,561, entitled "Knit Sleeve Pattern, Convergence of Pattern and Ribbing Structure for Apparel," and filed May 31, 2016. The entirety of the aforementioned application is incorporated by reference herein.

This application having attorney docket number NIKE.273935/150075US02 and entitled "Knit Sleeve Pattern," is related by subject matter to concurrently filed U.S. application Ser. No. 15/608,686, entitled "Knit Sleeve Convergence of Pattern" and U.S. application Ser. No. 15/608,697, entitled "Knit Sleeve Ribbing Structure." The entireties of the aforementioned applications are incorporated by reference herein.

TECHNICAL FIELD

The present disclosure relates to a knitted sleeve for an apparel item.

BACKGROUND

Sleeve portions of athletic apparel may be constructed with a variety of features for optimal wear and enhanced athletic performance. The placement and function of sleeve features with respect to a garment body may depend on the layout of the sleeve pattern piece relative to the overall garment pattern, the location of the sleeve relative to surrounding garment seams, and the particular structures engineered within the sleeve material to produce a desired characteristic.

BRIEF DESCRIPTION OF THE DRAWINGS

The present invention is described in detail below with reference to the attached drawing figures, wherein.

DETAILED DESCRIPTION

Figure 1A:
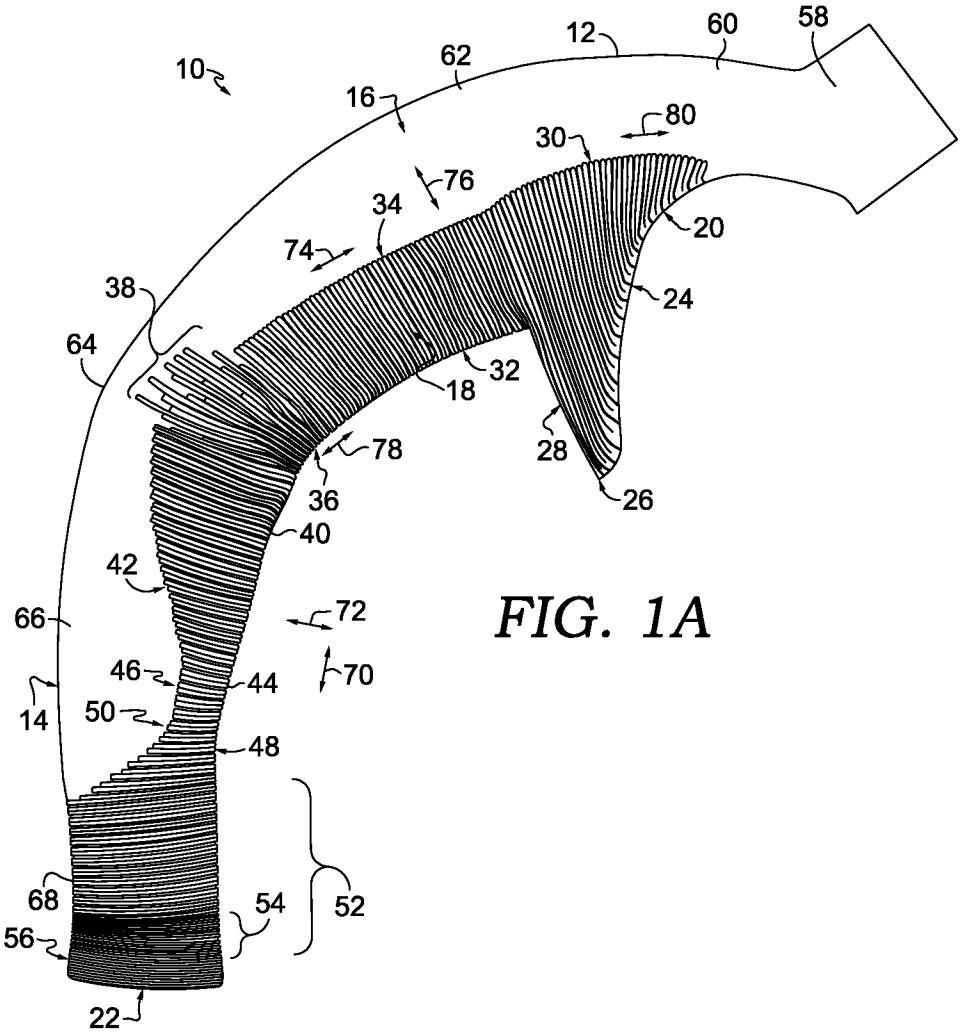
FIG. 1A depicts a front view of a knitted sleeve pattern, in accordance with aspects herein.

Present aspects hereof are directed toward a knit sleeve pattern. The knit sleeve pattern may have various pattern portions corresponding to different areas of a wearer's arm, such as a shoulder portion, a neckline extension, an elbow portion, a forearm portion, and a wrist portion. In further aspects, the underarm extension may displace a traditional underarm seam to a location below the upper arm portion, thereby including a front and back body extension.

In some aspects, a ribbed structure of a knit sleeve may provide ventilation, color-reveal qualities, curvature of a tailored sleeve shape, increased range of motion, and additional functional stability of the knit sleeve. In some aspects, the rib zones are located along the knit sleeve such that the various ribbing and venting components of each rib zone are automatically oriented near a particular portion of a wearer's arm. Additionally, the unitary construction and mirrored zonal qualities of the knit sleeve provides for a left-arm wearing or right-arm wearing assembly location for each knit sleeve, as coupled to a garment body, as well as a convergence between knitted features on front and back body extensions as mated to the upper arm of the sleeve. Especially with respect to knit sleeves, orientation and manipulation of functional sleeve features in relation to particular portions of a wearer's body may impact the resilience and function of the sleeve material for a variety of benefits, such as optimizing breathability, air permeability, moisture wicking, material strength, stretching characteristics, and ability to conform to a wearer's body.

In one exemplary aspect, a knitted sleeve pattern includes a tubular sleeve body comprising: a) an upper arm portion; b) a forearm portion; and c) an elbow portion between the upper arm portion and the forearm portion. The knitted sleeve pattern further comprises a shoulder portion adjacent a posterior sleeve edge of the tubular sleeve body said shoulder portion comprising a neck extension; and an underarm extension with respect to a garment body, said underarm extension adjacent an anterior sleeve edge of the tubular sleeve body, said underarm extension having a bottom edge displaced a threshold distance from the anterior sleeve edge.

In another exemplary aspect, a knit sleeve pattern comprises: a tubular fabric body comprising a neckline region, a shoulder region, an underarm extension region, an upper arm region, an elbow region, a forearm region, and a wrist region, each region of the tubular fabric body arranged along the tubular fabric body in a longitudinal orientation, wherein the tubular fabric body comprises a knit fabric formed from a single tubular structure comprising non-ribbed knit material, ribbed knit material, and vented knit material, and further wherein the tubular fabric body comprises a curved posterior sleeve edge and a curved anterior sleeve edge, said curved posterior sleeve edge and said curved anterior sleeve edge corresponding to one or more of a non-ribbed knit material, a ribbed knit material, and a vented knit material associated with each region of the tubular fabric body.

In a further exemplary aspect, a pattern for a knitted sleeve comprises: an upper arm region having an anterior sleeve edge and a posterior sleeve edge; a forearm region having an anterior sleeve edge and a posterior sleeve edge; an elbow region forming a curved structure between said upper arm region and said forearm region; an underarm extension proximate the anterior sleeve edge of the upper arm region, said underarm extension configured to displace an underarm seam when the knitted sleeve is assembled with a garment body; and a neckline extension proximate the posterior sleeve edge of the upper arm region, said neckline extension comprising a shoulder region and a neck opening.

In some aspects, a vented ribbing structure for a knitted sleeve comprises: a plurality of rib-knit structures perpendicular to a central axis of a tubular sleeve body; and a plurality of vent-knit structures perpendicular to the central axis of the tubular sleeve body, each of said plurality of vent-knit structures parallel to and between two or more of the plurality of rib-knit structures, wherein each of the plurality of vent-knit structures comprises at least one stretch portion and at least one vent portion, said at least one vent portion configured to open and close in response to stretching of the at least one stretch portion.

In another aspect, a ribbed sleeve material comprises: a first plurality of knitted ribs proximate a shoulder portion of a ribbed sleeve, said first plurality of knitted ribs comprising a first ribbed zone profile along a posterior edge of the first plurality of knitted ribs; a second plurality of knitted ribs proximate an upper arm portion of the ribbed sleeve, said second plurality of knitted ribs comprising a second ribbed zone profile along a posterior edge of the second plurality of knitted ribs; a third plurality of knitted ribs proximate an elbow portion of the ribbed sleeve, said third plurality of knitted ribs comprising a third ribbed zone profile along a posterior edge of the third plurality of knitted ribs; and a fourth plurality of knitted ribs proximate a forearm portion of the ribbed sleeve, said fourth plurality of knitted ribs comprising a fourth ribbed zone profile along a posterior edge of the fourth plurality of knitted ribs, wherein at least a portion of at least one of the first plurality, second plurality, third plurality, and fourth plurality of knitted ribs comprises at least one vented knit structure between at least two of the knitted ribs, said at least one vented knit structure comprising a stretch portion and a vent portion.

In further aspects, a vented ribbing structure for a sleeve comprises: a plurality of knitted ribs; a plurality of knitted vents adjacent two or more of the plurality of knitted ribs, each of the plurality of knitted vents comprising a plurality of stretch portions and a plurality of vent portions, each of the plurality of vent portions configured to move from a closed position to an open position in response to expansion and contraction of one or more of the plurality of knitted ribs, and further wherein the plurality of knitted vents are arranged parallel to the plurality of knitted ribs.

According to another aspect, a knit sleeve convergence pattern for an underarm extension of a knitted sleeve comprises: a rib knit first location comprising a plurality of first location knit ribs; a rib knit second location adjacent the rib knit first location, said rib knit second location comprising a plurality of second location knit ribs; a rib knit third location adjacent the rib knit first location and the rib knit second location, said rib knit third location comprising a plurality of third location knit ribs; and a convergence point comprising a central location between said plurality of first location knit ribs, said plurality of second location knit ribs, and said plurality of third location knit ribs.

In another aspect, a knit convergence pattern for an underarm portion of a sleeve comprises: a first plurality of knitted ribs proximate an upper sleeve portion of a sleeve; a second plurality of knitted ribs proximate a front body extension of the sleeve, said second plurality of knitted ribs adjacent said first plurality of knitted ribs; a third plurality of knitted ribs proximate a back body extension of the sleeve, said third plurality of knitted ribs proximate the first plurality and the second plurality of knitted ribs; and a central convergence point between said first plurality of knitted ribs, said second plurality of knitted ribs, and said third plurality of knitted ribs, wherein expansion in an expansion direction away from the central convergence point towards the first plurality of knitted ribs causes displacement of the second and third plurality of knitted ribs towards the central convergence point, wherein expansion in an expansion direction away from the central convergence point towards the second plurality of knitted ribs causes displacement of the first and third plurality of knitted ribs towards the central convergence point, and further wherein expansion in an expansion direction away from the central convergence point towards the third plurality of knitted ribs causes displacement of the first and second plurality of knitted ribs towards the central convergence point.

In some aspects, a knit sleeve pattern 10 includes a tubular fabric body 12 with a forearm portion 14, an upper arm portion 16, a plurality of knitted ribs 18, a plurality of knitted vents 20, a wrist opening 22, and an armpit edge 24, as shown in the exemplary knitted sleeve pattern 10 of FIG. 1A. The tubular fabric body 12 may further include a bottom edge 26 on an underarm extension 28 that displaces the underarm seam a threshold distance from the tubular fabric body 12 of the sleeve. In traditional configurations, such as a sleeve without the underarm extension 28 extending below a traditional underarm seam, an armhole opening of a garment body mates to an underarm seam edge, forming an underarm seam directly adjacent the armpit of a wearer. While this traditional underarm seam, extending along the circular edge/circumference of the tubular sleeve edge, may be positioned for traditional sleeve assembly, where one tube of fabric (the sleeve) meets another tube of fabric (the garment body), the presence of such seam near the wearer's armpit may cause chaffing or discomfort during wear, limit range of motion in one or more directions, and even destabilize the garment in an area of high stress, in some aspects.

However, in contrast to a sleeve pattern for a garment having a traditional underarm seam, the underarm extension 28 of the knit sleeve pattern 10 may include front and back body extensions that collectively form a bottom edge 26 for joining to a garment body. In one aspect, the underarm extension 28 may be knitted as part of a continuous material extending from the tubular fabric body 12, which can be joined to the armhole opening of a garment body along the armpit edge 24 in a displaced location at a threshold distance that extends inferior to a location of a traditional armpit/underarm seam.

In further aspects, the knit sleeve pattern 10 includes a shoulder 60 with front and rear neck extensions 58 that extend from the sleeve upper end 62 and forms at least a portion of the neckline of a garment to which the tubular fabric body 12 is joined. The shoulder 60 may include one more seamless features coupled to the tubular fabric body 12 such that the shoulder 60 and neck extension 58 provide an extension of the tubular fabric body 12, along the sleeve upper end 62 and beyond a traditional armhole shoulder seam located at the sleeve upper end 62 (i.e., without the shoulder 60 or neck extension 58). For example, the shoulder 60 may include a front neck extension 58 and a rear neck extension 58, forming at least a portion of both of the front and back neckline edges. As such, while a traditional tubular sleeve may be coupled to a garment body along a traditional shoulder seam (i.e., circumference of tubular structure), in some aspects, the tubular fabric body 12 may include additional material at the sleeve upper end 62 that extends to form a shoulder 60 and/or neck extension 58. In some aspects, the neck extension 58 becomes integral to the upper neckhole of a garment body, with edges of the neck extension 58, underarm extension 28, and armpit edge 24 joined to a garment body. Such joining along the outer perimeter of the tubular fabric body 12 may also reduce additional seam for an assembled garment (i.e., at least a portion of the shoulder seam, neckline seam, and/or underarm seam), thereby also minimizing discomfort and chaffing during wear, permitting range of motion in multiple directions, and stabilizing the garment in an area of potentially increased stress during wear and potential tearing along a sewn seam edge.

As further depicted in the example of FIG. 1A, multiple ribbing zones 32 may be positioned throughout the knit sleeve pattern 10, with each of the multiple ribbing zones 32 corresponding to at least a portion of the posterior sleeve edge 64 and/or anterior sleeve edge 48 when the knit sleeve pattern 10 is in an as-worn configuration by a hypothetical wearer standing in anatomical position. A tapering, shaping, curving, contouring, fitting, molding, shape-retaining, expanding, contracting, stretching, stabilizing, shrinking, seaming, extending, finishing, and/or other features incorporated into the knit sleeve pattern 10 may be associated with one or more knitted ribs 18 and/or knitted vents 20 of the multiple ribbing zones 32. As such, while the curved posterior sleeve edge 64 and the curved anterior sleeve edge 48 may be knitted to provide a curved outer edge of the knit sleeve pattern 10, in some aspects, at least one ribbing zone of the multiple ribbing zones 32 is positioned with respect to the upper arm portion 16, forearm portion 14, and/or armpit edge 24 to provide a specific shape to the overall knit sleeve pattern 10.

In one aspect, with both knitted rib 18 structures and knitted vent 20 structures in seamless construction across the multiple ribbing zones 32, the knit sleeve pattern 10 may include a symmetric non-ribbed material 66 adjacent a symmetric ribbed edge 44 along the tubular fabric body 12 of the curved, knit sleeve pattern 10. In one aspect, each ribbed zone within the multiple ribbing zones 32 is positioned along the tubular fabric body 12, from at least the sleeve upper end 62 towards the wrist opening 22 proximate a bottom end of the sleeve. In further aspects, the multiple ribbing zones 32 may include a first rib zone 30 proximate the underarm extension 28, a second rib zone 34 proximate the upper arm portion 16, a third rib zone 38 proximate the elbow portion 36, a fourth rib zone 40 proximate the forearm portion 14, and a fifth rib zone 52 proximate the wrist opening 22. As will be understood, although the knit sleeve pattern 10 is described with reference to first, second, third, fourth, and fifth rib zones 30, 34, 38, 40, and 52, in further aspects, the knit sleeve pattern 10 may include fewer rib zones or a greater number of rib zones as part of the multiple ribbing zones 32. For example, the knit sleeve pattern 10 may include a first rib zone 30 proximate the underarm extension 28 and a third rib zone 38 proximate the elbow portion 36. Similarly, while a profile edge of each of the ribbing zones may extend a particular length relative to the non-ribbed edge 66 along at least a portion of the posterior sleeve edge 64 and the ribbed edge 44 along the anterior sleeve edge 48, in some aspects, each profile edge of the various ribbed features may vary between different aspects of the knit sleeve pattern 10, as discussed in further detail below.

With continued reference to the exemplary multiple ribbing zones 32 of FIG. 1A, each of the ribbing zones may have similar or contrasting characteristics with respect to an adjacent ribbing zone, such as a different ribbing zone profile of a particular ribbing zone as compared to another. In some aspects, the multiple ribbing zones 32 may include various knitted rib 18 and/or knitted vent 20 pattern placement within the knit sleeve pattern 10 to provide various levels of tapering, shaping, curving, contouring, fitting, molding, shape-retaining, expanding, contracting, stretching, stabilizing, shrinking, seaming, extending, finishing, etc. In one aspect, at least one knit rib 18 and at least one knit vent 20 of the first rib zone 30 corresponds to a first stretch zone 80. Similarly, at least one knit rib 18 and at least one knit vent 20 of the second rib zone 34 corresponds to a second stretch zone 74. In one aspect, as first and second ribbed zones 30 and 34 include one or more stretch zone 80 and 74 stretch characteristics, the non-ribbed portion of the upper arm portion 16 may include a stretch zone 76 characteristics, such as an amount of stretch that counteracts an amount of relative stretch in the adjacent ribbed zones. In one example, each of the stretch zones 80, 74, and 76 may include varying stretch characteristics, such as an amount of stretch, an amount of resistance to stretch, a non-ribbed stretch characteristic, and/or a ribbed stretch characteristic based on an ability of each portion of the tubular fabric body 12 to move in one or more directions in response to a force applied to the sleeve material.

Additional stretch zones throughout the tubular fabric body 12 may include, in some aspects, a third stretch zone 78 associated with at least a portion of the third rib zone 38 proximate an elbow portion 36 and a fourth stretch zone 70 associated with the fifth rib zone 52 proximate the wrist opening 22. Similarly, a stretch zone 72 of the non-ribbed portion of the forearm portion 14 may include stretch zone 72 characteristics that counteract an amount of relative stretch in the adjacent ribbed zones. In some aspects, each of the stretch zones 78, 70, and 72 may include varying stretch characteristics such as an amount of stretch, an amount an amount of resistance to stretch, a non-ribbed stretch characteristic, and/or a ribbed stretch characteristic based on an ability of each portion of the tubular fabric body 12 to move in one or more directions in response to a force applied to the sleeve material.

As shown in the stretch zone examples with respect to the underarm extension 28, upper arm portion 16, elbow portion 36, forearm portion 14, and wrist opening 22, a height of the knitted ribs 18 in each area of the tubular fabric body 12 may be equivalent, staggered, graduated, increasing, decreasing, stepped, grouped, and any combination of lengths of knitted ribs 18. The knitted ribs 18 of a particular zone may therefore have a particular zone profile along an outer edge of the ribs relative to the anterior sleeve edge 48, according to various aspects. For example, the fourth rib zone 40 may include a decreasing gradient rib 42 adjacent an intermediate rib 46, which is adjacent an increasing gradient rib 50, along a curved profile of the forearm portion 14, relative to the anterior sleeve edge 48. In some aspects, the symmetric ribbed edge 44 along the anterior sleeve edge 48 extends across only a portion of the tubular fabric body 12, while in other aspects, the knit ribs 18 of a portion of the sleeve may extend around a circumference of the sleeve, such as the knitted ribs 18 of the fifth rib zone 52. Instead of including an outer profile of rib height along the sleeve, each of the ribs within the fifth rib zone may, in one aspect, encircle the sleeve with a double rib zone 68 adjacent a single rib zone 56 near the wrist opening 22. Additionally, a thumbhole opening 54 along the anterior sleeve edge 48 may be incorporated into at least a portion of the fifth rib zone 52 without interrupting the surrounding ribbing structure. As such, the symmetric, tubular fabric body 12 of the knit sleeve pattern 10 may include a right thumbhole (thumbhole opening 54 of FIG. 1A) or an alternative left thumbhole (thumbhole opening 54 of FIG. 1B), depending on orientation of the symmetric sleeve.

Figure 1B:
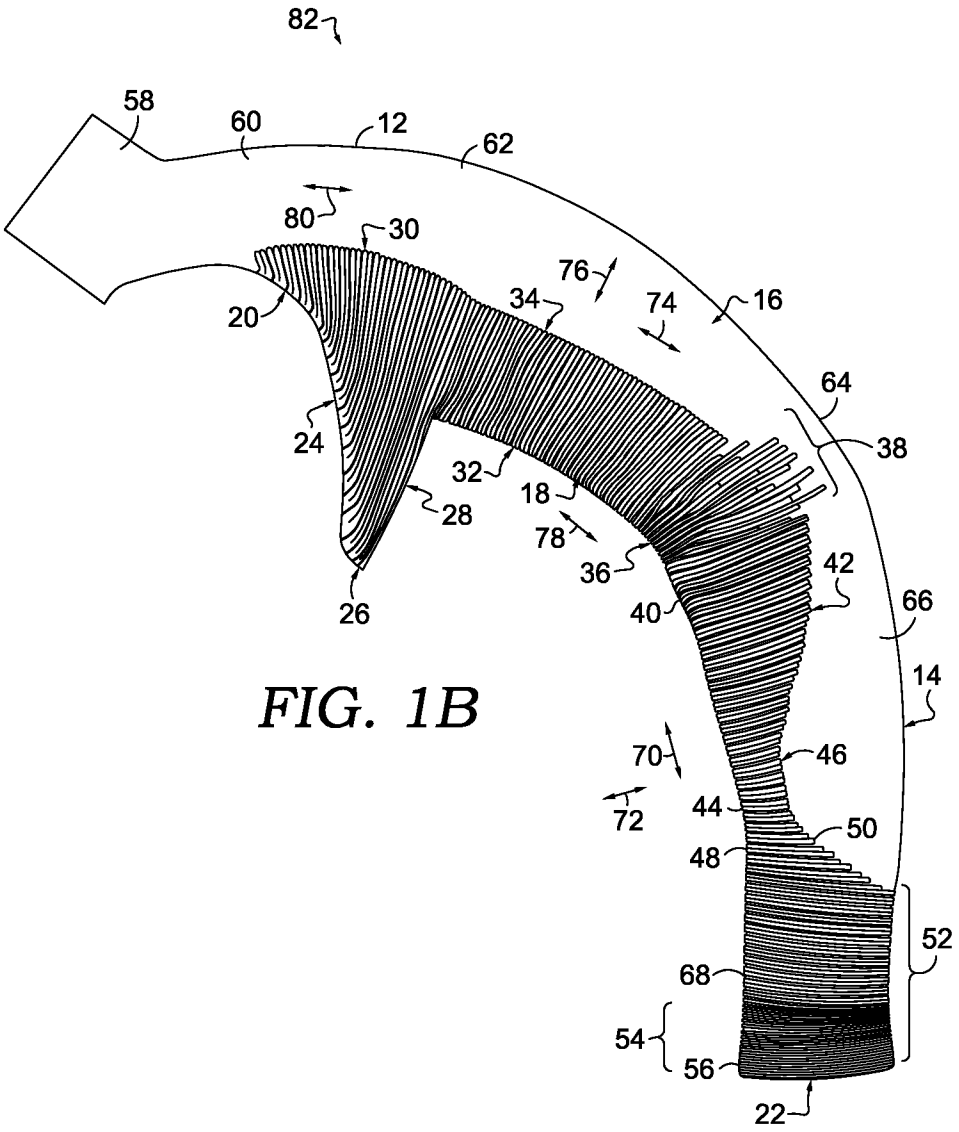
FIG. 1B depicts a back view of the knitted sleeve pattern of FIG. 1A, in accordance with aspects herein.

In the example of FIG. 1B, the symmetric ribbed edge 44 is opposite the symmetric non-ribbed edge 66 for a left-arm sleeve that is a mirror image of the right-arm sleeve in FIG. 1A. Accordingly, in some aspects, the knit sleeve patterns 10 and 82 provide a universal, tubular fabric body 12 of a sleeve for incorporating into both the left arm and right arm sides of a garment body. Further, as each knit sleeve pattern 10/82 includes at least a portion of a shoulder 60 and neck extension 58, each of the symmetric sleeves in FIGS. 1A and 1B may be used to form at least a portion of the left and right sides of a neck opening. Further, the symmetric underarm extension 28 may be configured to extend a bottom edge 26 of each armhole of a garment body, thereby displacing the underarm seam a threshold distance from a traditional underarm seam. In some aspects, as discussed further below, the symmetric underarm extension 28 of FIGS. 1A and 1B may extend a threshold distance below the sleeve upper end 62, such as an underarm extension 28 length that is between 5-50% of the overall length of the sleeve, while in further aspects, the underarm extension 28 is between 10-40% of the overall length of the sleeve.

Figure 2:
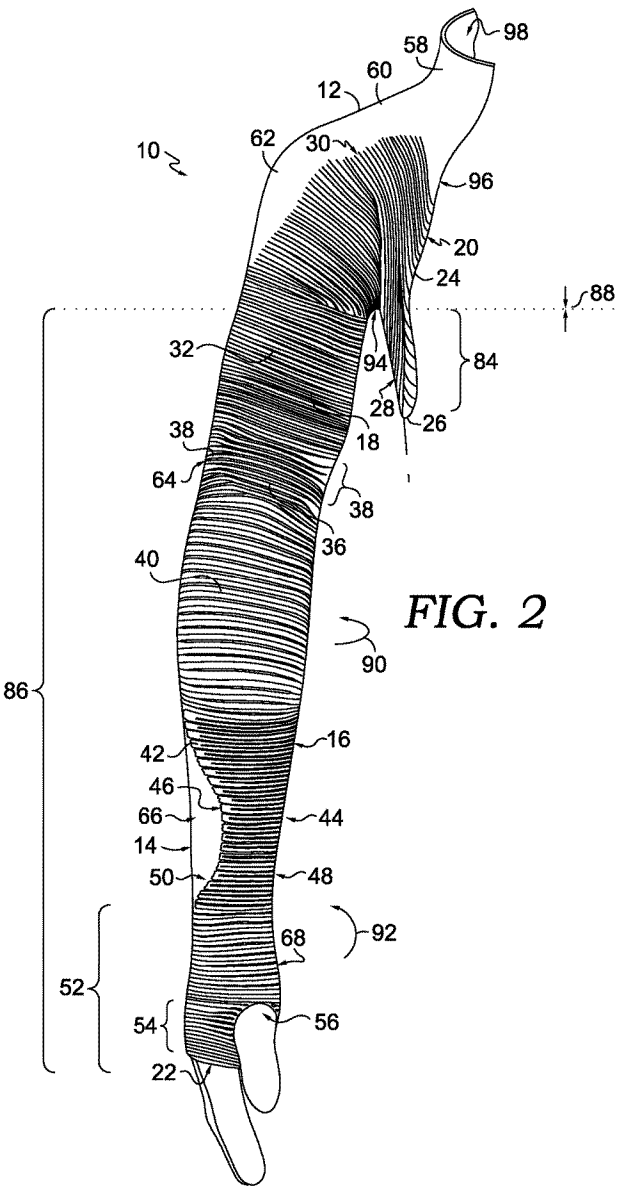
FIG. 2 depicts a front view of a knitted sleeve in an as-worn configuration on a right side of a wearer, in accordance with aspects herein.

Additionally, FIG. 2 depicts a front view of a knitted sleeve pattern 10 in an as-worn configuration on a right side of a wearer, in accordance with aspects herein. Once conformed to a wearer's arm, various features of the knit sleeve pattern 10 may become more emphasized, as the neck extension 58 is expanded to include an internal cavity 98, which terminates along the front wearer edge 96 that continues downward towards the bottom edge 26 of the underarm extension 28. As further depicted in FIG. 2, the wearer's upper arm portion 16 fills the sleeve while the elbow portion 36 is rotated slightly outward, in a forward direction 90. Similarly, the wearer's forearm portion 14 includes a broader view of the thumbhole opening 54 when rotated in an upward direction 92, with the wearer's fingers extending out of the wrist opening 22.

As outlined by exemplary brackets in FIG. 2, the underarm extension 28 may extend a first distance 84 relative to a reference point 88, while the tubular fabric body 12 extends a second distance 86 with respect to the reference point 88. In some aspects, the underarm extension 28 may be measured from an armpit region 94, which may also be referred to as a "true underarm" point from which the displacement of the bottom edge 26 is measured. As such, a length of the underarm extension 28 may be characterized as extending a first distance 84, from the armpit region 94 to the bottom edge 26, which may be between 10-40% of the second distance 86 of the tubular fabric body 12 from the reference point 88 (i.e., from the same armpit region 94) to the wrist opening 22.

Figure 3:
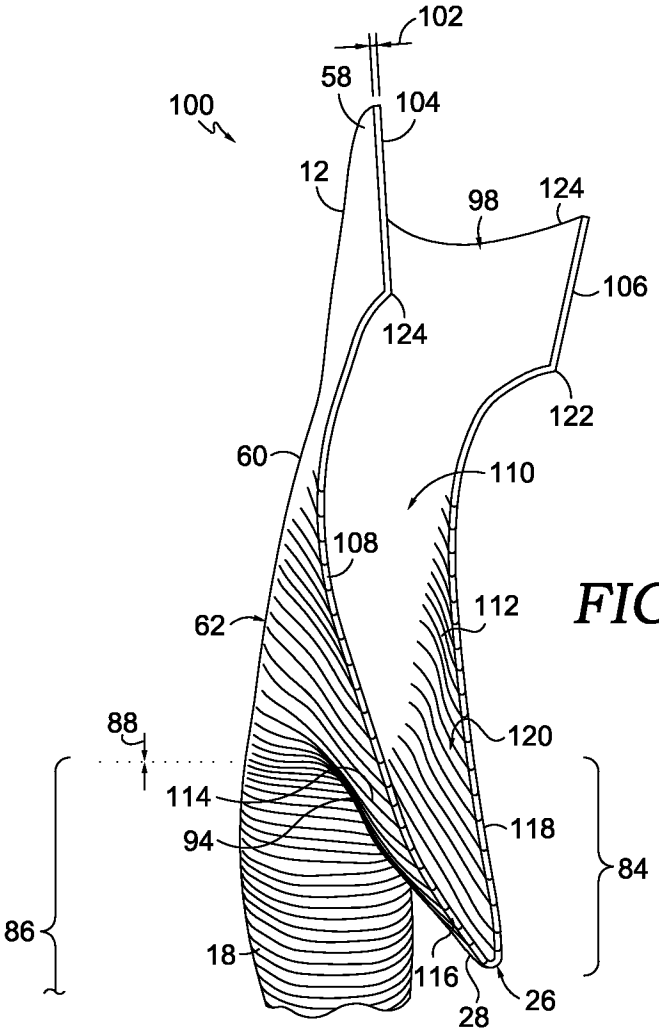
FIG. 3 depicts an interior, perspective view of a tubular, upper portion of the knitted sleeve, in accordance with aspects herein.

Turning next to FIG. 3, an interior, perspective view 100 of a tubular, upper portion of the knitted sleeve includes a material depth 102 of the tubular fabric body 12, with a first neck edge 104 opposite a second neck edge 106, a first body extension 108 opposite a second body extension 118, an internal sleeve cavity 110 adjacent the underarm cavity 120 that is surrounded by the ribbed features 114 of the first body extension 108, the ribbed features 112 of the second body extension 118, and the ribbed features 116 of the armpit region 94. In the view of FIG. 3, the displaced underarm portion of the knit sleeve pattern 10 are depicted with an enlarged view of the underarm extension 28 extending the first distance 84 below the armpit region 94.

Figure 4A:
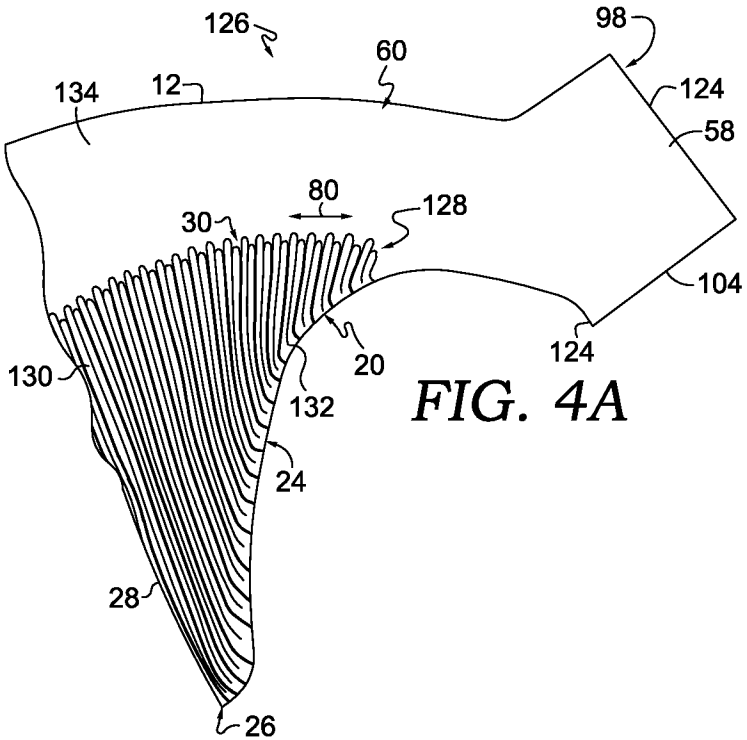
FIG. 4A depicts a front view of a first ribbed zone within a knitted sleeve, in accordance with aspects herein.
Figure 4B:
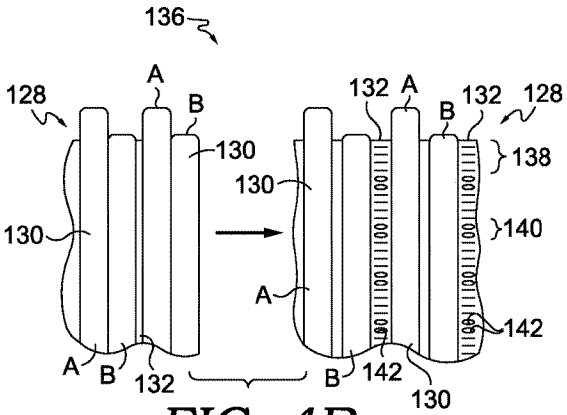
FIG. 4B depicts an enlarged view of a portion of the first ribbed zone in a contracted position and an expanded position, in accordance with aspects herein.

Turning next to FIG. 4A, the knitted sleeve 126 includes a first rib zone 30 having a first zone profile 128 with a series of knitted ribs 130 and knitted vents 132 in a double-rib, staggered orientation relative to the non-ribbed knit area 134 of the knitted sleeve 126. As shown in FIG. 4B, the enlarged view 136 of the staggered, first zone profile 128 includes knitted ribs 130 that alternate with knitted vents 132. In particular, in one aspect, the first rib zone 30 may include a double knitted rib 130 having a first rib A and a second rib B knitted adjacent the knitted vent 132. Accordingly, FIG. 4B also shows the expanded example of the knitted sleeve 126 structure, having the first rib A and second rib B of the knitted ribs 130 in an expanded position while the knitted vents 132 are further expanded to reveal the stretch portion 138, vent portion 140, and vent openings 142.

Figure 4C:
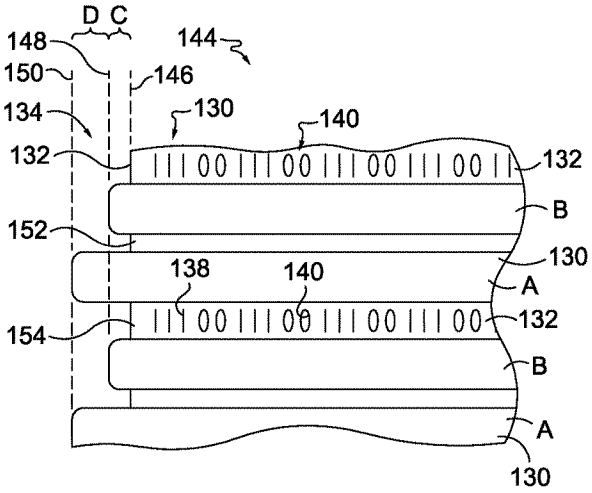
FIG. 4C depicts an enlarged view of the staggered profile of the first ribbed zone, in accordance with aspects herein.

The enlarged view 144 of FIG. 4C further depicts the staggered, first zone profile 128 of the first ribbed zone 30, according to one example. The knitted vents 132 may be constructed with a first height 146, adjacent the first rib A having a height 150 and the second rib B having a height 148. Additionally, a rib gap 152 may provide an amount of separation between the first rib A and the second rib B, while the vent gap 154 may correspond to the expanded position of the stretch portion 138 and vent portion 140 within the knitted sleeve 126. In some examples, the vent gap 154 may be emphasized with respect to the adjacent first rib A and second rib B, based on a color difference between the knitted ribs 130 and the knitted vents 132. For example, the expanded, knitted ribs of the vent gap 154 may reveal a knitted vent having a different visual characteristic than the surrounding knitted ribs 130 in either an expanded or contracted position.

Figure 5A:
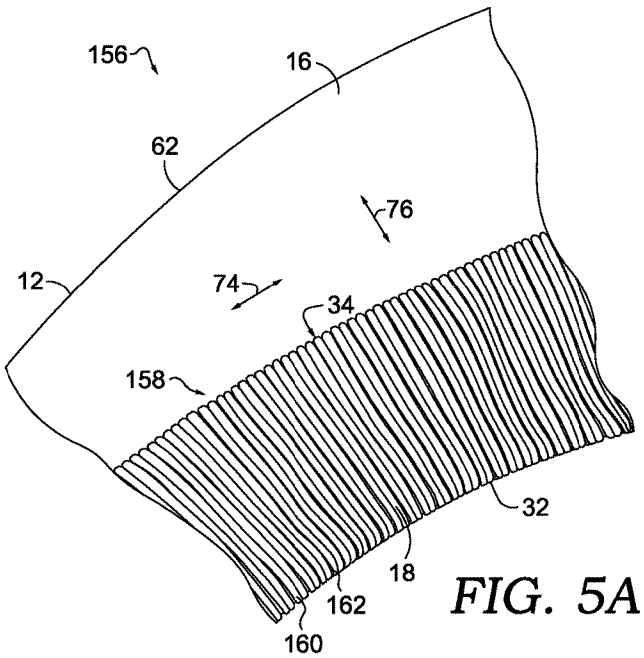
FIG. 5A depicts a front view of a second ribbed zone within a knitted sleeve, in accordance with aspects herein.
Figure 5B:
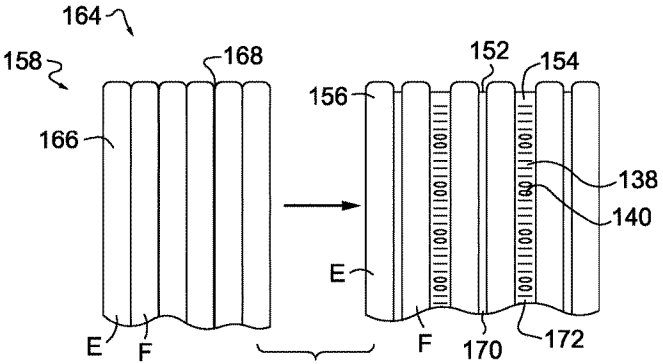
FIG. 5B depicts an enlarged view of a portion of the second ribbed zone in a contracted position and an expanded position, in accordance with aspects herein.

In FIG. 5A, the upper arm portion 16 of a knitted sleeve 156 includes a second zone profile 158, with a series of knitted ribs 160 adjacent a series of knitted vents 162. As shown in the enlarged view 164 in FIG. 5B, the double knitted ribs 130 include a first rib E and second rib F in a contracted position 166, adjacent the knitted vents 162 in a contracted position 168. Further, the same first and second ribs E and F are shown in an expanded position 170 adjacent an expanded vent 172, revealing the rib gap 152, vent gap 154, stretch portion 138, and vent portion 140.

Figure 6A:
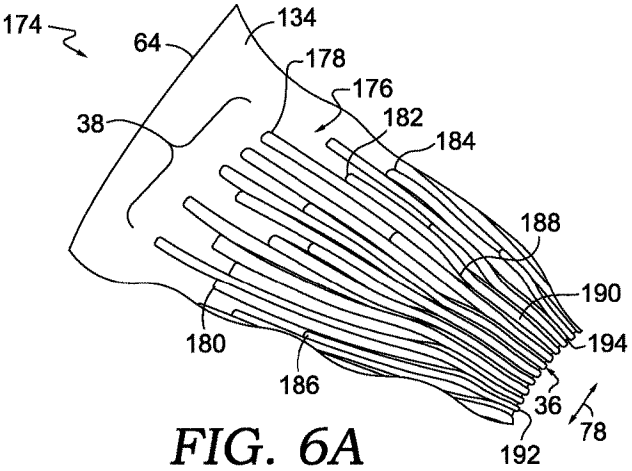
FIG. 6A depicts an enlarged view of a third ribbed zone within a knitted sleeve, in accordance with aspects herein.
Figure 6B:
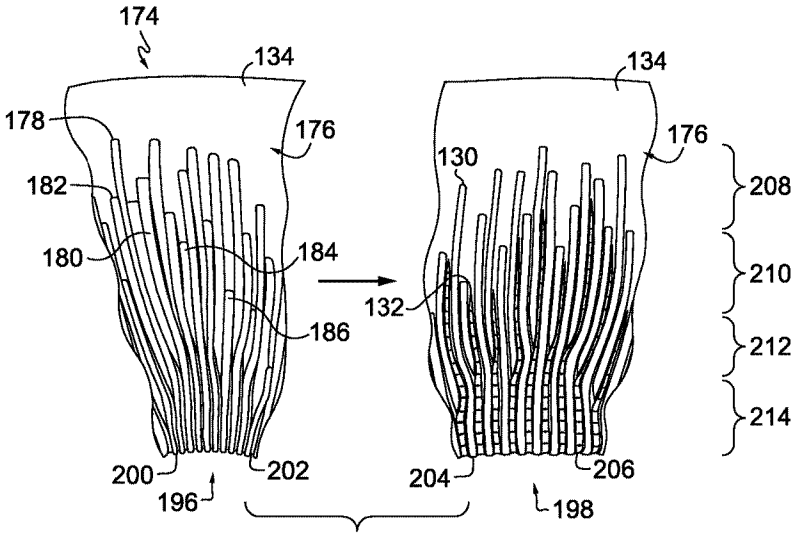
FIG. 6B depicts an enlarged view of a portion of the third ribbed zone in a contracted position and an expanded position, in accordance with aspects herein.

The third ribbed zone 38 is shown in the enlarged view of a portion of a knit sleeve 174 in FIG. 6A, and includes a variegated edge of the third zone profile 176. In some aspects, the third zone profile 176 includes multiple different heights of ribs and/or vented structures, such as a first rib height 178, a second rib height 180, a third rib height 182, a fourth rib height 184, and a fifth rib height 186. In one example, one or more of the various knitted ribs 18 of the third zone 38 may taper and/or combine with another adjacent knitted rib 18 proximate the posterior sleeve edge 64, and combine to form a single knitted rib 18 proximate the anterior sleeve edge 48. For example a knitted rib 18 having a first rib height 178 and a knitted rib 18 having a third rib height 182, may taper together at a taper point 188 to form a single tapered rib 190. In further aspects, the tapered, single ribs 192 within the third rib zone 38 may alternate with knitted vents 194 that provide ventilation along the curved elbow portion 36 of the knit sleeve 174.

As further shown in 6B, the enlarged view of the third zone profile 178 includes a contracted series 196 of tapered ribs 200 and vented ribs 202, which expands to an expanded series 198 of expanded ribs 204 and expanded vents 206. Additionally, with respect to the height of each rib and/or vent, the knit sleeve 174 may be ribbed with or without ventilation in the third ribbed zone 38. As such, the staggered, non-vented zone 208 is adjacent a staggered, vented zone 210. Further, the staggered, vented zone 210 is adjacent a vented, taper zone 212 adjacent a vented condensed rib 214.

Figure 7A:
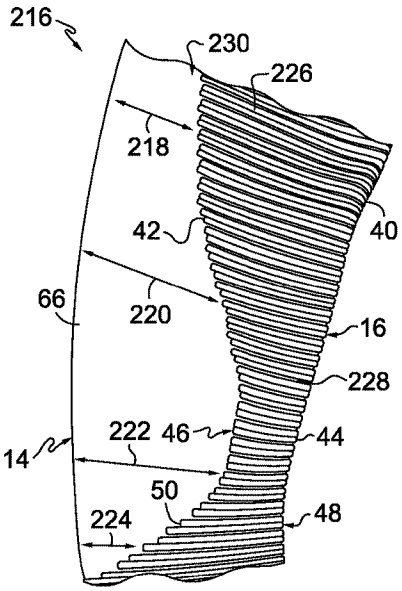
FIG. 7A depicts an enlarged view of a fourth ribbed zone within a knitted sleeve, in accordance with aspects herein.
Figure 7B:
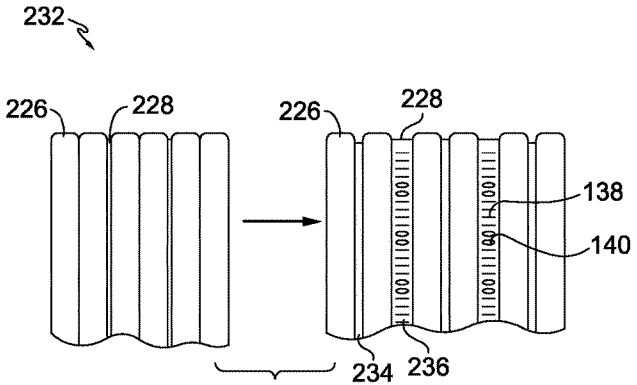
FIG. 7B depicts an enlarged view of a portion of the fourth ribbed zone in a contracted position and an expanded position, in accordance with aspects herein.

In another aspect, FIG. 7A depicts an enlarged view 216 of a fourth ribbed zone 40 adjacent the non-ribbed edge 66 having a fourth zone profile 230 corresponding to a plurality of knitted ribs 226 and knitted vents 228, with the fourth zone profile 230 corresponding to a first, non-ribbed portion 218, a second, non-ribbed portion 220, a third non-ribbed portion 222, and a fourth non-ribbed portion 224. In the enlarged view 232 of FIG. 7B, the knitted ribs 226 and knitted vents 228 move from a contracted position to an expanded position, revealing the rib gap 234 between adjacent knitted ribs 226, and the vent gap 236 having stretch portions 138 and vent portions 140.

Figure 8A:
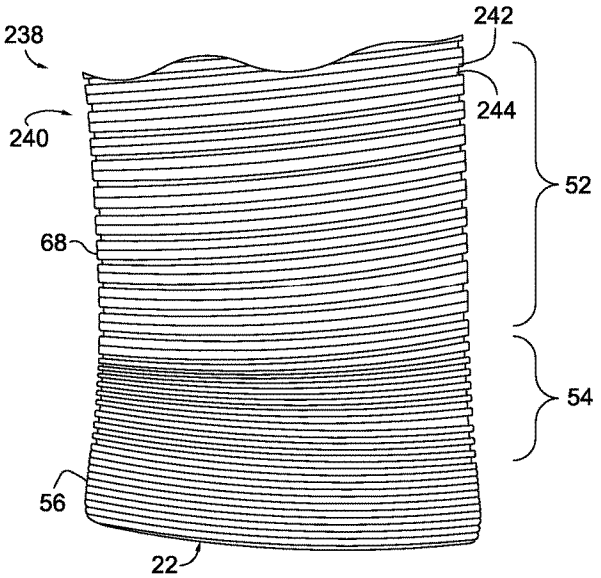
FIG. 8A depicts an enlarged view of a fifth ribbed zone within a knitted sleeve, in accordance with aspects herein.
Figure 8B:
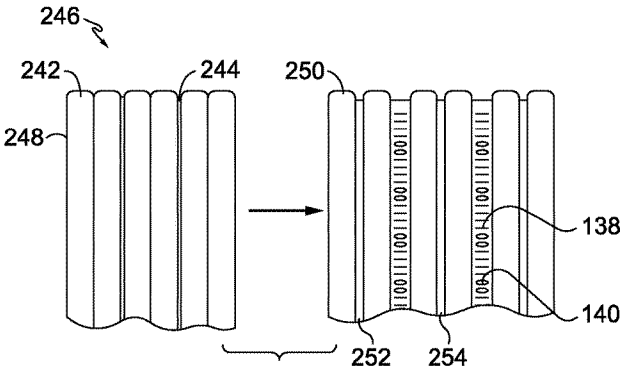
FIG. 8B depicts an enlarged view of a portion of the fifth ribbed zone in a contracted position and an expanded position, in accordance with aspects herein.

Continuing down the body of the tubular fabric body 12 of the knit sleeve pattern 10, the exemplary enlarged view 238 of the fifth ribbed zone 52 in FIG. 8A includes a series of knitted ribs 242 and knitted vents 244 around a circumference 240 of the sleeve. In FIG. 8B, the enlarged view 246 depicts a series of contracted ribs 248 that shifts to a set of expanded ribs 250, revealing the rib gap 252 and vent gap 254 of the fifth ribbed zone 52. Although depicted as including a similar stretch portion 138 and vent portion 140, in some aspects, the knitted vents 244 of each of the various ribbed zones within the knit sleeve pattern 10 may include different venting structures having different shapes, which may be adjacent different stretch structures having varying sizes or spacing within each expandable, knitted vent 244.

Figure 9:
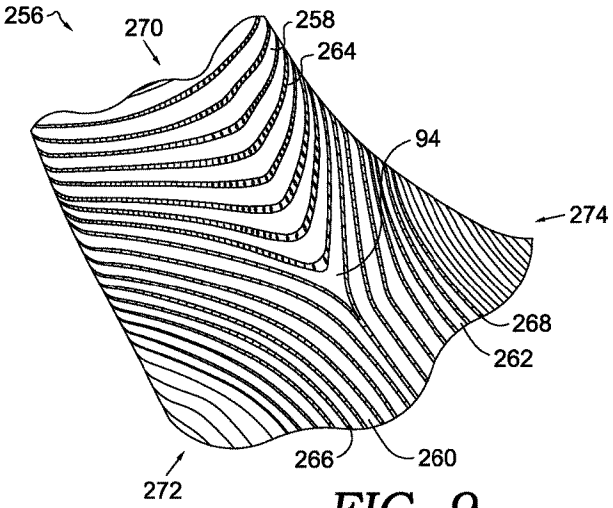
FIG. 9 depicts an enlarged, perspective view of an expanded, underarm convergence point of a knit sleeve, with a front convergence direction, back convergence direction, and an upper arm convergence direction, in accordance with aspects herein.
Figure 10:
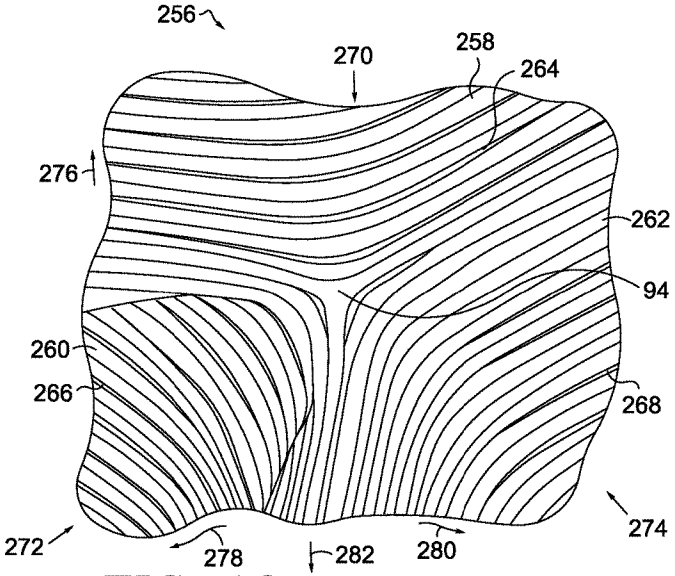
FIG. 10 depicts an enlarged, front view of a contracted, underarm convergence point of a knit sleeve, in accordance with aspects herein.

Turning now to FIGS. 9-10, the enlarged underarm view 256 includes one example of a convergence pattern of multiple knitted ribs 18 originating from various locations along the tubular fabric body 12. For example, the underarm view 256 includes a series of first knit ribs 258 and first knit vents 264 from an upper convergence direction 270, a series of second knit ribs 260 and second knit vents 266 from a back convergence direction 272, and a series of third knit ribs 262 and third knit vents 268 from a front convergence direction 274, which all converge and/or meet at armpit region 94. Each of the first knit ribs 258 are configured to expand in an upward direction 276, such as in an upward direction toward the upper arm portion 16 of the tubular fabric body 12. In further aspects, each of the second knit ribs 260 are configured to expand in an expansion direction 278 that opposes both the first knit ribs 258 and the third knit ribs 262. Additionally, each of the third knit ribs 262 are configured to expand in an expansion direction 280 that opposes both the first knit ribs 258 and the second knit ribs 260. Accordingly, each of the knitted ribs, and corresponding knitted vents, for each portion of the convergence pattern is oriented towards and away from the convergence point at the armpit region 94 so that they expand and contract relative to the armpit region 94. In other words, when located at an underarm region of a wearer, the convergence between the second knit ribs 260 and the third knit ribs 262 make up the front and back body extensions of a portion of the underarm extension 28. As such, the convergence of ribs in both the back convergence direction 272 and the front convergence direction 274 direct the inward and downward tapering of the knitted ribs along the underarm extension 28.

Figure 11:
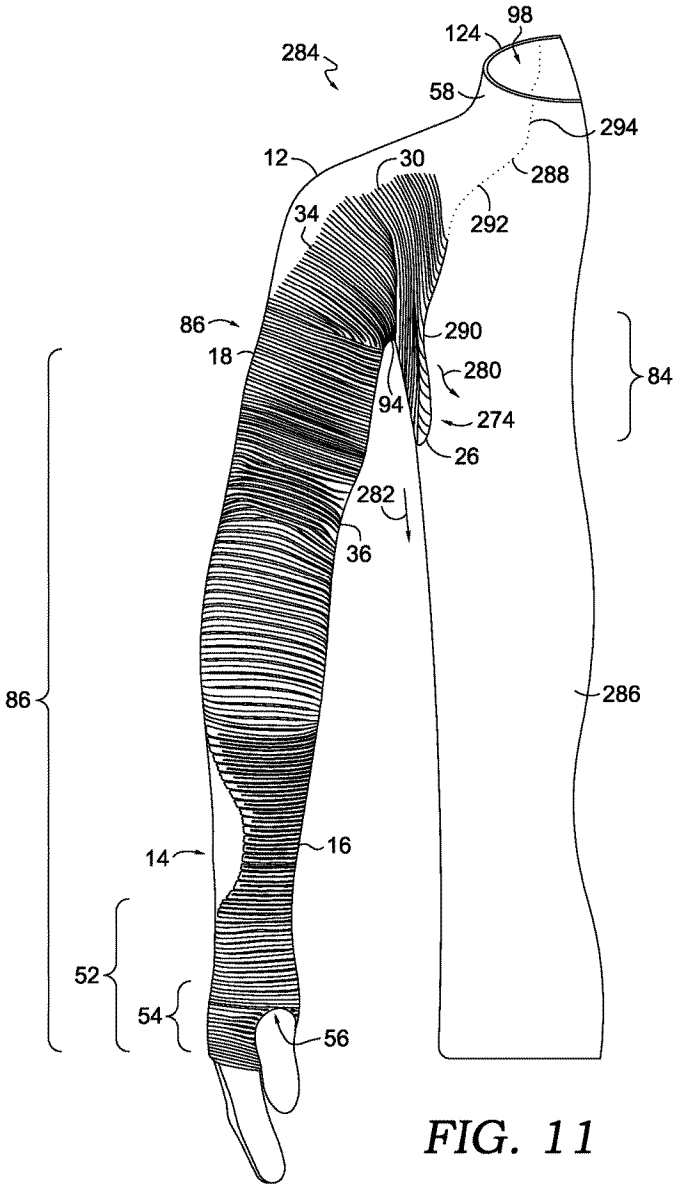
FIG. 11 depicts a front view of a knitted sleeve in an as-worn configuration and coupled to an armhole of a corresponding garment body.

Finally, with reference to FIG. 11, the front view 284 of a knitted sleeve pattern 10 depicts one example of a tubular fabric body 12 coupled to a garment body 286 in an as-worn configuration. In some aspects, the sleeve seam 288 between the tubular fabric body 12 and the garment body 286 includes an underarm extension seam 290, a body extension seam 292, and a neck seam 294. In some aspects, having coupled an outer edge of the knitted sleeve pattern 10 to the garment body 286, the bottom edge 26 of the underarm extension 28 is displaced from a location of a traditional underarm seam, with respect to armpit region 94. As further shown in FIG. 11, the convergence pattern of ribbing structures associated with the upper arm portion 16, front body extension of the underarm extension 28, and back body extension of the underarm extension 28, are joined along the underarm extension seam 290 and incorporated into the offset armpit, according to some aspects.

Present aspects hereof have been described in relation to particular examples, which are intended in all respects to be illustrative rather than restrictive. From the foregoing, it will be seen that the present aspects are well adapted to attain all the ends and objects set forth above, together with other advantages, which are obvious and inherent to the system and method. It will be understood that certain features and subcombinations are of utility and may be employed without reference to other features and subcombinations. This is contemplated by and is within the scope of the claims.

What is claimed is:

1. A knitted sleeve pattern comprising:

a tubular sleeve body, the tubular sleeve body comprising:

a) an upper arm portion;

b) a forearm portion; and c) an elbow portion between the upper arm portion and the forearm portion;

a shoulder portion adjacent a posterior sleeve edge of the tubular sleeve body, the shoulder portion comprising a neck extension; and an underarm extension adjacent an anterior sleeve edge of the tubular sleeve body, the underarm extension having a bottom edge displaced a threshold distance from the anterior sleeve edge, wherein the underarm extension is knit as a part of a seamless material extending from the tubular sleeve body, and wherein the underarm extension comprises a front body and a back body that collectively form the bottom edge for joining to an armhole opening of a garment body along an armpit edge in a displaced location a threshold distance that extends inferior to a traditional armpit seam location.

2. The knitted sleeve pattern of claim 1, wherein the forearm portion comprises a wrist portion.

3. The knitted sleeve pattern of claim 1, wherein the tubular sleeve body comprises a curved profile along at least a portion of the anterior sleeve edge proximate the elbow portion, the curved profile corresponding to a plurality of knitted ribs of the elbow portion.

4. The knitted sleeve pattern of claim 1, wherein the neck extension comprises a knitted material front and a knitted material back.

5. The knitted sleeve pattern of claim 1, wherein the front body extension and the back body extension taper toward the bottom edge of the underarm extension.

6. The knitted sleeve pattern of claim 1, wherein the tubular sleeve body comprises a tubular sleeve body length, the tubular sleeve body length comprising a distance between a sleeve upper end and a wrist opening of the forearm portion.

7. The knitted sleeve pattern of claim 6, wherein the underarm extension comprises an underarm extension length between 10-40% of the tubular sleeve body length.

8. The knitted sleeve pattern of claim 7, wherein the underarm extension comprises an underarm extension width between 30-50% of a diameter of at least a portion of the tubular sleeve body.

9. The knitted sleeve pattern of claim 6, wherein the neck extension comprises a neck extension length up to 20% of the tubular sleeve body length.

10. The knitted sleeve pattern of claim 1, comprising a convergence zone proximate a transition between at least a portion of the underarm extension and at least a portion of the tubular sleeve body.

11. A knit sleeve pattern comprising:

a tubular fabric body comprising a neckline region, a shoulder region, an underarm extension region, an upper arm region, an elbow region, a forearm region, and a wrist region, each region of the tubular fabric body arranged along the tubular fabric body in a longitudinal orientation, wherein the tubular fabric body comprises a knit fabric formed from a single tubular structure comprising non-ribbed knit material, ribbed knit material, and vented knit material, further wherein the tubular fabric body comprises a curved posterior sleeve edge and a curved anterior sleeve edge, the curved posterior sleeve edge and the curved anterior sleeve edge corresponding to the one or more of the non-ribbed knit material, the ribbed knit material, and the vented knit material associated with each region of the tubular fabric body, and further wherein the underarm extension region is knit as a part of a seamless material extending from the tubular fabric body, the underarm extension region comprising a front body and a back body that collectively form a bottom edge for joining to an armhole opening of a garment body along an armpit edge in a displaced location a threshold distance that extends inferior to a traditional armpit seam location.

12. The knit sleeve pattern of claim 11, wherein the bottom edge of the underarm extension region extends below an upper end of the upper arm region at a distance between 10-40% of a length of the tubular fabric body.

13. The knit sleeve pattern of claim 11, wherein the single tubular structure comprises a symmetric construction comprising a front side and a back side, each of the front side and the back side comprising mated portions of the non-ribbed knit material, the ribbed knit material, and the vented knit material.

14. The knit sleeve pattern of claim 13, wherein each of the mated portions of the ribbed knit material and the vented knit material corresponds to the curved anterior sleeve edge, and further wherein each of the mated portions of the non-ribbed knit material corresponds to the curved posterior sleeve edge.

15. A pattern for a knitted sleeve comprising:

an upper arm region having an anterior sleeve edge and a posterior sleeve edge;

a forearm region having an anterior sleeve edge and a posterior sleeve edge;

an elbow region forming a curved structure between the upper arm region and the forearm region;

an underarm extension proximate the anterior sleeve edge of the upper arm region and knit as a part of a seamless material extending from a tubular sleeve body, wherein the underarm extension comprises a front body and a back body that collectively form a bottom edge for joining to an armhole opening of a garment body along an armpit edge in a displaced location a threshold distance that extends inferior to a traditional armpit seam location; and a neckline extension proximate the posterior sleeve edge of the upper arm region, the neckline extension comprising a shoulder region and a neck opening.

16. The pattern of claim 15, further comprising a plurality of knitted ribs and a plurality of knitted vents along at least a portion of the anterior sleeve edge.

* * * * *